US010825408B2

(12) United States Patent
Shan

(10) Patent No.: US 10,825,408 B2
(45) Date of Patent: Nov. 3, 2020

(54) DISPLAY DRIVING METHOD, DEVICE AND APPARATUS

(71) Applicant: HKC CORPORATION LIMITED, Shenzhen (CN)

(72) Inventor: Jianfeng Shan, Shenzhen (CN)

(73) Assignee: HKC CORPORATION LIMITED, Shenzhen, Guangdong ( * ) Notice: Subject to any disclaimer, the term of this patent is extended or adjusted under 35 U.S.C. 154(b) by 396 days.

(21) Appl. No.: 15/751,425

(22) PCT Filed: Dec. 8, 2017

(86) PCT No.: PCT/CN2017/115186
§ 371 (c)(1),
(2) Date: Feb. 8, 2018

(87) PCT Pub. No.: WO2019/071777
PCT Pub. Date: Apr. 18, 2019

(65) Prior Publication Data

US 2020/0226987 A1 Jul. 16, 2020

(30) Foreign Application Priority Data

Oct. 10, 2017 (CN) ..... 2017 1 0937010

(51) Int. Cl.
*G09G 3/36* (2006.01)
*G09G 5/10* (2006.01)

(52) U.S. Cl.
CPC ..... *G09G 3/3607* (2013.01); *G09G 5/10* (2013.01)

(58) Field of Classification Search
CPC ..... G09G 3/3648; G09G 3/3607; G09G 2320/0242; G09G 3/3426; G09G 5/026;
(Continued)

(56) References Cited

U.S. PATENT DOCUMENTS 10,629,143 B2 * 4/2020 Shan ..... G09G 5/026
10,643,353 B2 * 5/2020 Baldwin ..... G06T 11/001
(Continued)

FOREIGN PATENT DOCUMENTS

CN 101345036 A 1/2009
CN 102103840 B 3/2013
(Continued)

OTHER PUBLICATIONS

Chinese Office Action dated Mar. 26, 2019.
International Search Report dated Jul. 11, 2018.

*Primary Examiner* — Bryan Earles
(74) *Attorney, Agent, or Firm* — Platinum Intellectual Property LLP

(57) ABSTRACT

The application relates to a display driving method, device and apparatus. The method includes: acquiring a group of original gray scale data of each of pixel units of a content to be displayed in a preset display area; determining an average gray scale of each of hues in the preset display area according to the group of the original gray scale data; acquiring an original light source intensity of each of the hues of the content to be displayed in the preset display area; and dividing the group of the original gray scale data into a first group of gray scale data and a second group of gray scale data, according to the group of the original gray scale data of the each of pixel units, the average gray scale of each of the hues, and the original light source intensity; and determining a driving light source intensity of each of the hues in the preset display area; a gray scale of each of the hues of the first group of the gray scale data is a maximum gray scale in the group of the original gray scale data; and a gray scale of each of the hues of the second group of the gray scale data is equal to 0 or not a minimum gray scale in the group of the original gray scale data.

18 Claims, 5 Drawing Sheets

(58) Field of Classification Search
CPC .... G09G 3/36; G09G 5/10; G09G 2320/0686; G09G 2320/028; G09G 2320/0233; G09G 2310/027
See application file for complete search history.

(56) References Cited

U.S. PATENT DOCUMENTS

| | | | | |
|---|---|---|---|---|
| 2010/0123401 | A1 | 5/2010 | Park et al. | |
| 2014/0152724 | A1 | 6/2014 | Park et al. | |
| 2019/0295208 | A1* | 9/2019 | Hoarty | G09G 5/393 |
| 2020/0020285 | A1* | 1/2020 | Shan | G09G 3/3426 |
| 2020/0020287 | A1* | 1/2020 | Shan | G09G 3/3426 |

FOREIGN PATENT DOCUMENTS

| | | | |
|---|---|---|---|
| CN | 105096875 | A | 11/2015 |
| CN | 106873205 | A | 6/2017 |
| CN | 107657928 | A | 2/2018 |
| CN | 107945751 | A | 4/2018 |
| CN | 107808647 | B | 6/2019 |

* cited by examiner

DISPLAY DRIVING METHOD, DEVICE AND APPARATUS

RELATED APPLICATIONS

This application is a United States National Stage Application filed under 35 U.S.C 371 of PCT Patent Application Serial No. PCT/CN2017/115186 filed Dec. 8, 2017, which claims Chinese Patent Application Serial No. CN 201710937010.1, filed Oct. 10, 2017, the disclosure of all of which are hereby incorporated by reference in their entirety.

FIELD OF THE INVENTION

The present disclosure relates to the field of display technology, and particularly to a display driving method, device and apparatus.

BACKGROUND OF THE INVENTION

With the continuous development of science and technology, various liquid crystal display apparatuses, such as a liquid crystal television, a liquid crystal display and the like, have been popularized continuously, and are widely applied in various places where information display is required, such as residences, shopping malls, office buildings and the like, so that life and production of people are facilitated.

However, among changes in color shifts of the side view angle and the front view angle of various representative color systems of a conventional liquid crystal display, color shifts of the side view angle of red, green and blue of the color systems are more serious than those of other color systems. Moreover, since the luminance ratio of view angle of the gray scale liquid crystal display is saturated and increased rapidly, the lower the gray scale, the larger the difference between the luminance of the front view angle and the luminance of the side view angle.

SUMMARY OF THE INVENTION

On the basis of this, it is necessary to provide a display driving method, device and apparatus, which can improve the color shift of the side view angle.

A display driving method includes:

acquiring a group of original gray scale data of each of pixel units of a content to be displayed in a preset display area;

determining an average gray scale of each of hues in the preset display area according to the group of the original gray scale data;

acquiring an original light source intensity of each of the hues of the content to be displayed in the preset display area; and dividing the group of the original gray scale data into a first group of gray scale data and a second group of gray scale data, according to the group of the original gray scale data of the each of pixel units, the average gray scale of each of the hues, and the original light source intensity; and determining a driving light source intensity of each of the hues in the preset display area; a gray scale of each of the hues of the first group of the gray scale data is a maximum gray scale in the group of the original gray scale data; and a gray scale of each of the hues of the second group of the gray scale data is equal to 0 or greater than a minimum gray scale in the group of the original gray scale data.

A display driving device includes:

an original gray scale acquirement module configured to acquire a group of original gray scale data of each of pixel units of a content to be displayed in a preset display area;

an average gray scale determination module configured to determine an average gray scale of each of the hues in the preset display area according to the group of the original gray scale data;

an original light source acquirement module configured to acquire an original light source intensity of each of the hues of the content to be displayed in the preset display area; and a gray scale group division module configured to decompose the group of the original gray scale data into a first group of gray scale data and a second group of gray scale data, according to the group of the original gray scale data of the each of pixel units, the average gray scale of each of the hues, and the original light source intensity; and determine a driving light source intensity of each of the hues in the preset display area; a gray scale of each of the hues of the first group of the gray scale data is a maximum gray scale in the group of the original gray scale data; and a gray scale of each of the hues of the second group of the gray scale data is equal to 0 or greater than a minimum gray scale in the group of the original gray scale data.

a storage medium storing a computer program that, when executed by a processor, steps of the above display driving method are implemented.

A computer apparatus, including a memory, a processor and a computer program stored on the memory and executed on the processor, wherein steps of the above display driving method are implemented when the processor executes the computer program.

On the basis of this, for the display driving method, device and apparatus, the group of the original gray scale data is divided into a first group of gray scale data and a second group of gray scale data, that is to say, an original frame signal corresponding to each of pixel units is combined into a plurality of frames; further, a gray scale of each of the hues of the first group of the gray scale data is a maximum gray scale in the group of the original gray scale data; and a gray scale of each of the hues of the second group of the gray scale data is equal to 0 or greater than a minimum gray scale in the group of the original gray scale data. Whereby, in order to highlight the dominant color and improve the color shift, the gray scale data of each of the hues in the original group of the gray scale data is displayed according to the data greater than the minimum gray scale in the original group of the gray scale data, or not displayed directly; and both groups do not contain the data color of the minimum gray scale in the original group of the gray scale data, thereby reducing the luminance difference between the hue of the low gray scale of the side view angle and the hue of the overall pixel unit, such that the hue of the side view angle appears close to the hue of the front view angle, display of the low color shift is achieved, and the luminance is the same as that of the picture quality of the original picture and is presented.

DETAILED DESCRIPTION OF THE EMBODIMENTS

The above objects, features and advantages of the present invention will become more apparent by describing in detail embodiments thereof with reference to the accompanying drawings. It should be understood that these embodiments depicted herein are only used to illustrate the present invention and are not therefore to limit the present invention.

Figure 1:
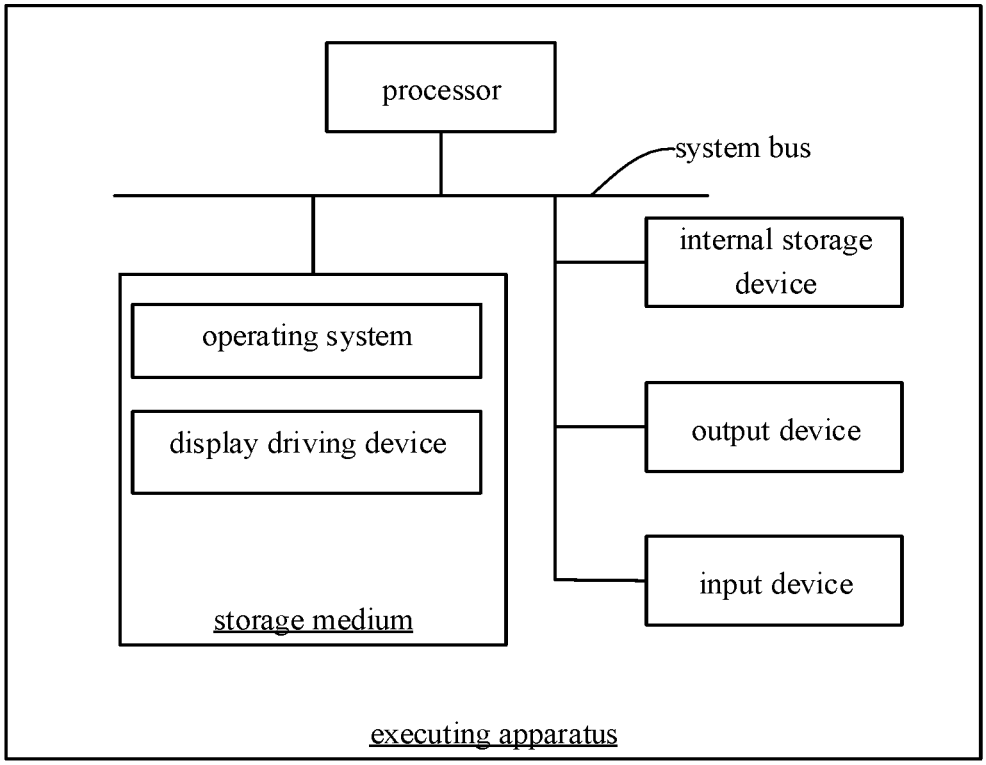
FIG. 1 is a schematic diagram of an internal structure of an executing apparatus of a display driving method and device according to an embodiment.

FIG. 1 is a block diagram of the internal structure of an executing apparatus according to an embodiment. The executing apparatus can be a terminal that effects the display driving method. The executing apparatus includes a processor, a storage medium, an internal storage device, an output device and an input device connected through the system bus. an operating system and a computer application program of a display driving device are stored in the storage medium of the executing apparatus, a driving method of display is implemented when the computer application program of the display driving device is executed by the processor. The processor is configured to provide computation and control capability to support the operation of the executing apparatus. The internal storage device of the executing apparatus provides an operation environment to the computer application program of the display driving device in the storage medium; the internal storage device can store computer-readable instructions that, when executed by the processor, cause the processor to perform a display driving method. The output device of the executing apparatus can be a display screen; the display screen can be a liquid crystal display. The input device of the executing apparatus can be a touch layer covered on the display screen, a button, a trackball or a touch pad disposed on the housing of the executing apparatus, or an external keyboard, touch pad or mouse and so on. Persons skilled in the art may understand that, the structure shown in FIG. 1 is only a block diagram of a part of structure related to the present solution, which does not impose limitation to the executing apparatus to which the present solution is applied; and the specific executing apparatus may include components more or less than those shown in the drawing, or may combine some components, or may have different component arrangement.

Figure 2:
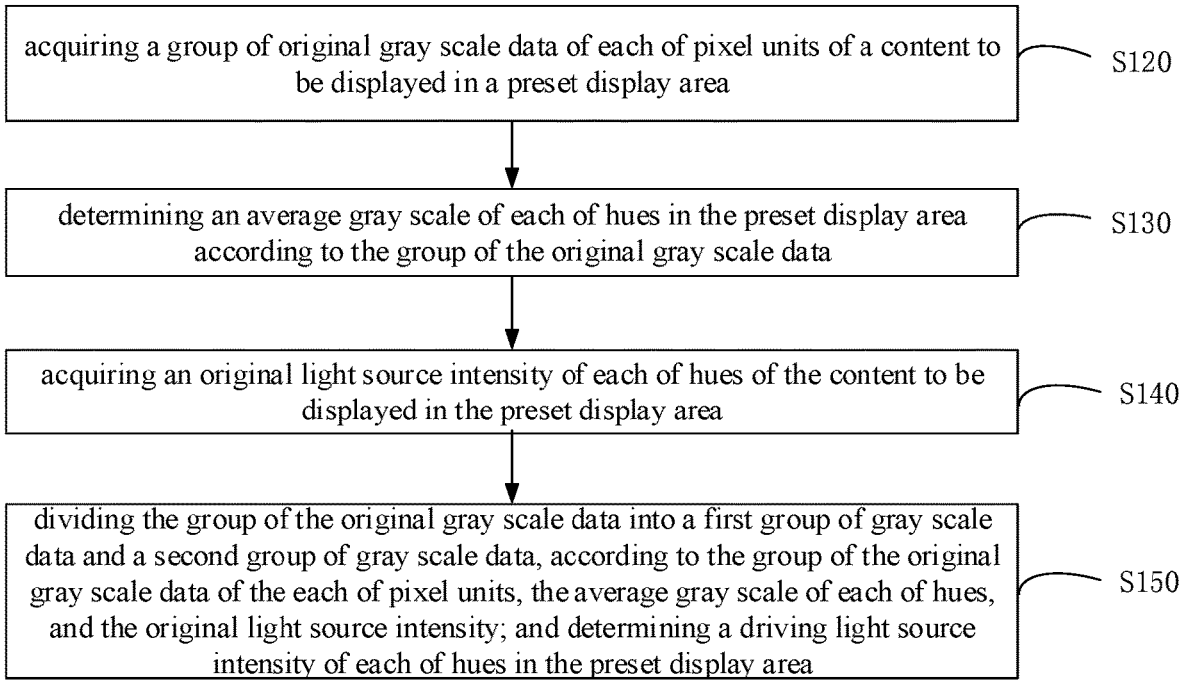
FIG. 2 is a flow chart of a display driving method according to an embodiment.

Referring to FIG. 2, the application provides a display driving method including:

S120: a group of original gray scale data of each of pixel units of a content to be displayed is acquired in a preset display area.

The liquid crystal display is formed by a plurality of RGB sub-pixel units. Each group of RGB sub-pixel units is referred to as a pixel unit, and each of pixel units represents an image signal. A group of original gray scale data of each of pixel units includes gray scales of three kinds of R, G B hues. The display region of the display may be divided into a plurality of display areas, and each of the display areas includes at least two pixel units. A size of the display area may be customized, and the display area may be divided into N (columns) * M (rows) display partitions formed by pixel units. For example, ($R_{n,\ m\text{-}i,j}$, $G_{n,\ m\text{-}i,j}$, $B_{n,\ m\text{-}i,j}$) can represent a group of original gray scale of the pixel unit of the i-th column and the j-th row in the display area of the n-th column and the m-th row. The display driving method may be implemented by sequentially regarding each of display areas as a preset display area in accordance with a preset order.

S130: an average gray scale of each of hues is determined in the preset display area according to the group of the original gray scale data.

The average gray scale of each of the hues is determined in the preset display area according to the group of the original gray scale data of each of the hues in the preset display area. The average gray scale of each of the hues in the preset display region, i.e. a group of average gray scales in the preset display area, may be acquired by summing the group of the original gray scale data of each of the hues of each of pixel units respectively and then dividing by the number of pixel units in the preset display area. For example, ($Ave_R_{n,\ m}$, $Ave_G_{n,\ m}$, $Ave_B_{n,\ m}$) can represent the group of average gray scales of the display area of the n-th column and m-th row.

S140: an original light source intensity of each of the hues of the content to be displayed is acquired in the preset display area.

The original light source intensity of each of the hues of the content to be displayed in the preset display area, i.e. a group of original light source intensities of the content to be displayed in the preset display area, may be acquired by a look-up table. It can be understood that the look-up table may be pre-stored in the memory and directly called when needed. The look-up table may also be acquired when needed, so as to acquire the group of the original light source intensities of the content to be displayed in the preset display area. ($A_{n,\ m_}R$, $A_{n,\ m_G}$, $A_{n,\ m_B}$) can be configured to represent acquirement of the group of the original light source intensities of the content to be displayed in the display area of the n-th column and the m-th row.

S150: the group of the original gray scale data is divided into a first group of gray scale data and a second group of gray scale data, according to the group of the original gray scale data of the each of pixel units, the average gray scale of each of the hues, and the original light source intensity; and a driving light source intensity of each of the hues in the preset display area is determined; a gray scale of each of the hues of the first group of the gray scale data is a maximum gray scale in the group of the original gray scale data; and a gray scale of each of the hues of the second group of the gray scale data is equal to 0 or greater than a minimum gray scale in the group of the original gray scale data.

The driving light source intensities of R, Q B of the two frames may be adjusted in the preset display area according to the average gray scales (such as $Ave_R_{n,\ m}$, $Ave_G_{n,\ m}$, $Ave_B_{n,\ m}$) of the hues of all the pixel units in the preset display are. $A_{n,\ m_R}$, $A_{n,\ m_G}$, $A_{n,\ m_B}$ of the original light source intensities of the hues of R, G B are adjusted to $A'_{n,m_R}$, $A'_{n,m_G}$, $A'_{n,m_B}$ in the display area (n, m).

For the display driving method, the group of the original gray scale data is divided into a first group of gray scale data and a second group of gray scale data, that is to say, an original frame signal corresponding to each of pixel units is combined into a plurality of frames; further, a gray scale of each of the hues of the first group of the gray scale data is a maximum gray scale in the group of the original gray scale data; and a gray scale of each of the hues of the second group of the gray scale data is equal to 0 or greater than a minimum gray scale in the group of the original gray scale data. Whereby, in order to highlight the dominant color and improve the color shift, the gray scale data of each of the hues in the original group of the gray scale data is displayed according to the data greater than the minimum gray scale in the original group of the gray scale data, or not displayed directly; and both groups do not contain the data color of the minimum gray scale in the original group of the gray scale data, thereby reducing the luminance difference between the hue of the low gray scale of the side view angle and the hue of the overall pixel unit, such that the hue of the side view angle appears close to the hue of the front view angle, display of the low color shift is achieved, and the luminance is the same as that of the picture quality of the original picture and is presented.

Figure 3:
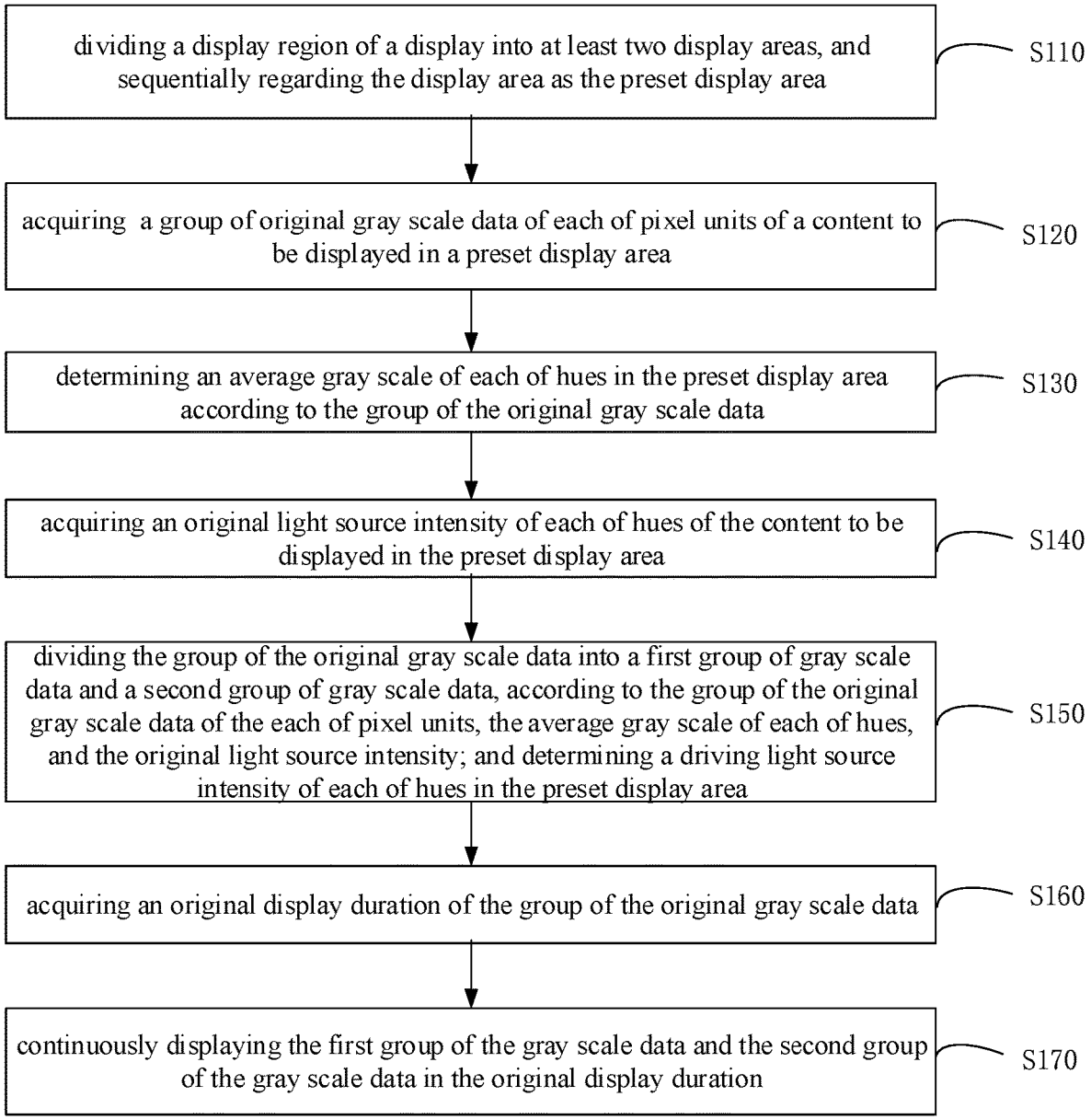
FIG. 3 is a flow chart of a display driving method according to another embodiment.

Referring to FIG. 3, in an embodiment, after the step of dividing the group of the original gray scale data into the first group of the gray scale data and the second group of the gray scale data, the method further includes:

S160: an original display duration of the group of the original gray scale data is acquired.

S170: the first group of the gray scale data and the second group of the gray scale data are continuously displayed in the original display duration.

In this embodiment, a group of gray scale data of an original frame corresponding to a pixel unit is divided into a first group of gray scale data and a second group of gray scale data of two frames (a first frame and a second frame) corresponding to the pixel unit; and a combination of two frames is sequentially presented over the original display time, that is to say, the first group of the gray scale data and the second group of the gray scale data are sequentially displayed. The original display duration is divided into two time periods, where the first group of the gray scale data is shown in one time period, and the second group of the gray scale data is shown in the other time period. Preferably, in order to ensure the display effect, the durations of the two time periods are the same, that is, they are both half of the original display duration.

Figure 4:
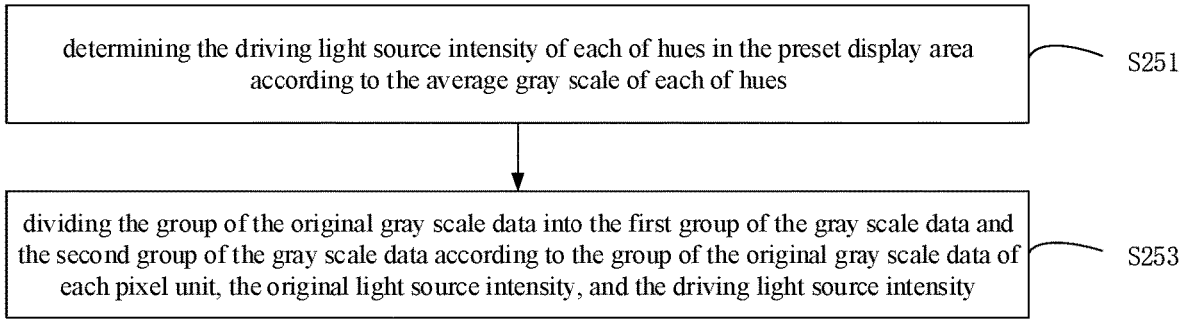
FIG. 4 is a specific flow chart of the step of the display driving method in FIG. 2 or FIG. 3.

Referring to FIG. 4, the step of dividing the group of the original gray scale data into the first group of the gray scale data and the second group of the gray scale data, according to the group of the original gray scale data of the each of pixel units, the average gray scale of each of the hues, and the original light source intensity; and determining the driving light source intensity of each of the hues in the preset display area includes:

S251: the driving light source intensity of each of the hues is determined in the preset display area according to the average gray scale of each of the hues.

It may be determined according to the average gray scale in the preset display area that the maximum gray scale in the average gray scale belongs to the maximum average gray scale subpixel dominated by which hue of R, G and B; and it is determined that the maximum gray scale of most pixel units is the hue of one sub-pixel of R, G and B in the preset display region. In this way, the driving light source intensity of each of the hues can be further determined in the preset display area according to the hue corresponding to the maximum gray scale in the average gray scale of each of the hues in the preset display area.

Assuming that the average gray scales of the hues of all the pixel units in the display area (n, m) are $Ave_R_{n,m}=A$, $Ave_G_{n,m}=B$, $Ave_B_{n,m}=C$, where A>B>C, so that the area is a combination of red hues. The average gray scales $Ave_R_{n,m}$, $Ave_G_{n,m}$, $Ave_B_{n,m}$ of the hues of R, G and B are divided into two frame gray scale combinations respectively: R1G1B1 combination 1 (the first group of the gray scale data) and R2G2B2 combination 2 (the second group of the gray-scale data). Where the gray scale of each of the hues in the R1G1B1 combination 1 is the maximum gray scale in the average gray scale, i.e. A; that is, R1=A, G1=A, and B1=A. The gray scale of each of the hues in the R2G2B2 combination 2 is: the hue R2 corresponding to the maximum average gray scale A is equal to 0, and the gray scales of the two hues G2 and B2 is the second maximum average gray scale, i.e. B, that is, R2=0, G2=B, B2=B.

The driving light source intensities $A'_{n,m_R}$, $A'_{n,m_G}$, $A'_{n,m_B}$ of respective hues of R, G and B are calculated according to the gray scales of respective hues of the first group of the gray scale data and the second group of the gray scale data, such that the overall luminance of R, G and B signals maintains the same as that of the original frame. The driving light source intensities $A'_{n,m_R}$, $A'_{n,m_G}$, $A'_{n,m_B}$ of respective hues of R, G and B are calculated as follows:

$$A'_{n,m_R}=2*TR(A)*A_{n,m_R}/(TR(A)+0)=2*A_{n,m_R};$$

$$A'_{n,m_G}=2*TG(B)*A_{n,m_G}/(TG(A)+TG(B));$$

$$A'_{n,m_B}=2*TB(C)*A_{n,m_B}/(TB(A)+TB(B)).$$

It should be noted that the luminance ratios corresponding to the average gray scales of respective hues of R, G and B may be acquired in the preset display area by a look-up table: TR (A), TG (B) and TB (C) respectively. The luminance ratios corresponding to respective hues of the first group of the gray scale data can be acquired by a look-up table: TR (A), TG (A) and TB (A) respectively. The luminance ratios corresponding to respective hues of the second group of the gray scale data can be acquired by a look-up table: TR (0)=0, TG (B) and TB (B) respectively. The luminance ratio is the luminance ratio value of the gray scale of the corresponding hue to the full gray scale. It can be understood that these look-up tables can be pre-stored in the memory, and the corresponding luminance ratios can be directly acquired when needed. The data tables can also be acquired when needed, so as to acquire the luminance ratios.

S253: the group of the original gray scale data is divided into the first group of the gray scale data and the second group of the gray scale data according to the group of the original gray scale data of each of pixel units, the original light source intensity, and the driving light source intensity.

According to the maximum gray scale of each of the hues in the group of the original gray scale data of each of pixel units, the first group of the gray scale data of the first frame corresponding to the pixel unit can be determined. In combination with the first group of the gray scale data, the original light intensity and the driving light source intensity, a group of luminance ratios of the gray scale of the second frame corresponding to the pixel unit after division to the full gray scale can be determined according to law of luminance conservation. The group of luminance ratios includes the luminance ratio of each of the hues; it can be understood that the luminance ratio is the luminance ratio value of the gray scale of the corresponding hue to the full gray scale. After the two groups of luminance ratios are determined, the gray scale of each of the hues in the first group of the gray scale data and the second group of the gray scale data may be determined by a look-up table. It should be noted that the frame corresponding to the pixel unit includes the original frame corresponding to the pixel unit before division, and the first frame and the second frame corresponding to the pixel unit after division.

Further, the step of dividing the group of the original gray scale data into the first group of the gray scale data and the second group of the gray scale data according to the group of the original gray scale data of each of pixel units, the original light source intensity, and the driving light source intensity includes:

(a). a maximum gray scale of each of the hues of the pixel unit is regarded as the gray scale of each of the hues of the first group of the gray scale data.

(b). a luminance ratio of the gray scale of each of the hues of the first group of the gray scale data to a full gray scale is determined according to the gray scale of each of the hues of the first group of the gray scale data.

(c). a luminance ratio of the gray scale of each of the hues of the second group of the gray scale data to the full gray scale is determined according to the luminance ratio of the gray scale of each of the hues of the first group of the gray scale data to the full gray scale, the original light source intensity, and the driving light source intensity.

Case 1:

The average gray scales of respective hues of all the pixel units in the preset display area are $Ave_R_{n,m}=A$, $Ave_G_{n,m}=B$ and $Ave_B_{n,m}=C$, where A>B>C, so that the display area is a combination of red hues. The group of the original gray scale data of most pixel units in the preset display region is represented as ($R_{n,m_i,j}=A1$, $G_{n,m_i,j}=B1$, $B_{n,m_i,j}=C1$), and most pixel units meet the combination of red hues of A1>B1>C1. In this case, the maximum gray scale in the group of the original gray scale data of the pixel unit $R_{i,j}$, $G_{i,j}$, $B_{i,j}$ is A1. The pixel unit is divided from 1 frame (the original frame) into a combination of two frames (a first frame and a second frame). After division, the gray scales of respective hues of $R_{i,j}$, $G_{i,j}$ and $B_{i,j}$ corresponds to the first group of the gray scale data ($R1_{i,j}$, $G1_{i,j}$, $B1_{i,j}$) and the second group of the gray scale data ($R2_{i,j}$, $G2_{i,j}$, $B2_{i,j}$) respectively. Wherein, the gray scale of each of the hues of the first group of the gray scale data is the maximum gray scale in the group of the original gray scale data, i.e. A1, that is, $R1_{i,j}=A1$, $G1_{i,j}=A1$, $B1_{i,j}=A1$. The luminance ratios of the gray scales of respective hue of the first group of the gray scale data to the full gray scale may be determined by a look-up table: TR (A1), TG (A1) and TB (A1) respectively. In combination with the original light source intensities $A_{n,m_R}$, $A_{n,m_G}$, $A_{n,m_B}$ and the driving light source intensities $A'_{n,m_R}$, $A'_{n,m_G}$, $A'_{n,m_B}$ of each of the hues of R, G and B in the preset display area, the luminance ratios TR ($R2_{i,j}$), TG ($G2_{i,j}$), TB ($B2_{i,j}$) of the gray scales of respective hues of the second group of the gray scale data to the full gray scale can be determined according to law of luminance conservation, so that the gray scale of each of the hues can be further determined by a look-up table according to the luminance ratio. In one specific example, the calculation formula of the luminance ratios TR ($R2_{i,j}$), TR ($G2_{i,j}$) and TB ($B2_{i,j}$) of the gray scales of respective hues of the second group of the gray scale data to the full gray scale is as follows:

$$TR(R2_{ij})=(2*A_{n,m_R}*TR(A1)-A'_{n,m_R}*TR(A1))/A'_{n,m_R}=0;$$

$$TG(G2_{ij})=(2*A_{n,m_G}*TG(B1)-A'_{n,m_G}*TG(A1)))/A'_{n,m_G}=((TG(A)+TG(B))/TG(B))*TG(B1)-TG(A1);$$

$$TB(B2_{ij})=(2*A_{n,m_B}*TB(C1)-A'_{n,m_B}*TB(A1))/A'_{n,m_B}=((TB(A)+TB(B))/TB(C))*TB(C1)-TB(A1).$$

Case 2:

The average gray scales of respective hues of all the pixel units in the preset display area are $Ave_R_{n,m}=A$, $Ave_G_{n,m}=B$ and $Ave_B_{n,m}=C$, where A>B>C, so that the display area is a combination of red hues. If the group of the original gray scale data of other pixel units is present in the preset display area as ($R'_{ij}=A2$, $G'_{ij}=B2$, $B'_{ij}=C2$), the pixel unit is a combination of green hues of B2>C2>A2, which is different from the size order of the average gray scale of the preset display area. The gray scales of each of the hues of the pixel unit $R'_{ij}$, $G'_{ij}$, $B'_{ij}$ is divided from 1 frame (an original frame) into a combination of two frames (a first frame and a second frame) corresponding to the first group of the gray scale data ($R'1_{ij}$, $G'1_{ij}$, $B'1_{ij}$) and the second group of the gray scale data ($R'2_{ij}$, $G'2_{ij}$, $B'2_{ij}$) respectively. Wherein, the gray scale of each of the hues of the first group of the gray scale data is the maximum gray scale in the group of the original gray scale data, i.e. B2, that is, $R'1_{ij}=B2$, $G'1_{ij}=B2$, $B'1_{i,j}=B2$. The luminance ratios of the gray scales of respective hue of the first group of the gray scale data to the full gray scale may be determined by a look-up table: TR (B2), TG (B2) and TB (B2) respectively. In combination with the original light source intensities $A_{n,m_R}$, $A_{n,m_G}$, $A_{n,m_B}$ and the driving light source intensities $A'_{n,m_R}$, $A'_{n,m_G}$, $A'_{n,m_B}$ of each of the hues of R, G and B in the preset display area, the luminance ratios TR ($R2_{i,j}$), TG ($G2_{i,j}$), TB ($B2_{i,j}$) of the gray scales of respective hues of the second group of the gray scale data to the full gray scale can be determined according to law of luminance conservation, so that the gray scale of each of the hues can be further determined by a look-up table according to the luminance ratio. In one specific example, the calculation formula of the luminance ratios TR ($R2_{i,j}$), TR ($G2_{i,j}$) and TB ($B2_{i,j}$) of the gray scales of respective hues of the second group of the gray scale data to the full gray scale is as follows:

$$TR(R'2_{i,j})=(2*A_{n,m_R}*TR(A2)-A'_{n,m_R}*(TR(B2)))/A'_{n,m_R}=TR(A2)-TR(B2),\ \text{if } TR(R'2_{i,j})>Y, TR(R'2_{i,j})=Y,\ \text{if } TR(R'2_{i,j})<0, TR(R'2_{i,j})=0;$$

$$TG(G'2_{i,j})=(2*A_{n,m_G}*TG(B2)-A'_{n,m_G}*(TG(B2)))/A'_{n,m_G}=((TG(A)+TG(B))/TG(B))*TG(B2)-TG(B2),\ \text{if } TG(G'2_{i,j})>Y, TG(G'2_{i,j})=Y,\ \text{if } TG(G'2_{i,j})<0, TG(G'2_{i,j})=0;$$

$$TB(B'2_{i,j})=(2*A_{n,m_B}*TB(C2)-A'_{n,m_B}*(TB(C2)))/A'_{n,m_B}=((TB(A)+TB(B))/TB(C))*TB(C2)-TB(B2),\ \text{if } TB(B'2_{i,j})>Y, TB(B'2_{i,j})=Y,\ \text{if } TB(B'2_{i,j})<0, TB(B'2_{i,j})=0.$$

It should be noted that since the size order of the group of the original gray scale data of the pixel unit is different from that of the average gray scale of the preset display region, the luminance ratios of the gray scales of respective hues of the second group of the gray scale data ($R'2_{ij}$, $G'2_{ij}$, $B'2_{ij}$) corresponding to the pixel unit to the full gray scale may be determined by the above formula, and then the luminance ratio may be lower than 0 or greater than a preset maximum value. Therefore, it should be required to determine values of the calculated luminance ratios $TR(R'2_{ij})$, $TG(G'2_{i,j})$ and $TB(B'2_{ij})$ of the gray scales of respective hues of the second group of the gray scale data to the full gray scale. If the value is less than 0, the luminance ratio is set to be 0; and if the value is greater than the preset maximum value Y, the luminance ratio is set as the preset maximum value Y.

In an embodiment, the step of determining the driving light source intensity of each of the hues in the preset display area includes: determining that a driving light source intensity of the hue corresponding to the maximum gray scale in the average gray scales of the preset display area is set to be 0 when the second group of the gray scale data is displayed.

Since the maximum gray scale of the average gray scales is regarded as the average gray scale of a hue in the preset display area, the hue corresponding to the maximum gray scale of most pixel units in the preset display area is consistent with the hue corresponding to the maximum gray scale. Further, the maximum gray scale is regarded as the gray scale of each of the hues of the first group of the gray scale data at the same time. Therefore, it is determined that the driving light source intensity of the hue corresponding to the maximum gray scale in the average gray scales of the preset display area is set to be 0 when the second group of the gray scale data is displayed, which has little effect on the overall display, and at the same time, can also achieve the function of energy conservation and emission reduction.

As in case 1 in the above embodiment, the preset display expects that the size order of the gray scales of respective hues of most pixel units is consistent with that of the average gray scale of $Ave_R_{n,\ m}$=A, $Ave_G_{n,\ m}$=B, $Ave_B_{n,m}$=C, Where A>B>C. After the group of the original gray scale data is divided, the driving light source intensity A'n,m_R of the red hue of the first group of the gray scale data is twice of the original luminance intensity of the above red hue, namely A'n,m_R=2*An,m_R. The driving light source intensity $A'_{n,m_R}$ of the red hue of the second group of the gray scale data can be set as a signal of 0. As in Case 2 of the above embodiment, when the preset display expects that the size order of the gray scales of respective hues $R'_{i,j}$, $G'_{i,j}$ and $B'_{i,j}$ of most pixel units is different from that of the average gray scale of $Ave_R_{n,\ m}$=A, $Ave_G_{n,\ m}$=B, $Ave_B_{n,m}$=C, where A>B>C. In this case, the luminance ratios of respective hues of the second group of the gray scale data are calculated according to the original light source intensity and the driving light source intensity respectively as follows: $TR(R'2_{i,j})=(2*A_{n,m_R}*TR(A2)-A'_{n,m_R}*(TR(B2)))/A'_{n,m_R}=TR(A2)-TR(B2)$, and then it can be determined that TR(A2)−TR(B2)<0. At this time, The gray scale $R'2_{i,j}$ of the red hue of the second group of the gray scale data can be set to be 0, which cooperates with the above case that the driving light source intensity $A'_{n,m_}R$ of the second group of the gray scale data is set to be 0 without affecting the overall result. Therefore, the driving light source intensity of the red hue can be set to be 0 when the second group of the gray scale data is displayed in the preset display area, that is to say, the R LED light source of the backlight can be turned off, so that the function of energy conservation can be achieved. It can be understood that in other embodiments, the hue corresponding to the maximum gray scale in the average gray scales may also be green or blue, which is not limited to the red in the above embodiment.

In an embodiment, the step of determining the driving light source intensity of each of the hues in the preset display area includes: (I) and (II).

(I). an average hue and saturation of the preset display area are acquired.

The average hue and saturation of the preset display area may be acquired according to the average gray scale in the preset display area by using a color space system to determine the average hue and saturation of the preset display area. Among them, the color space system may be a CIE LCH color space system, where CIE LCH is a R, G, B three-color spatial coordinate system proposed by CIE (Commission Internationale de L'Eclairage). The coordinate system includes L (Luminance), C(Chroma) and H (Hue), and can be determined by the coordinate functions of the CIE specification. The coordinate functions can be respectively expressed as L=f1(R, G, B), C=f1(R, G, B), H=f1(R, G, B), where H is the color representative, and color rendering of different hues can be represented by 0° to 360°, wherein 0° is defined as red, 90° is defined as yellow, 180° is defined as green, and 270° is defined as blue; C is Chroma on behalf of the vivid degree of color, the range of C is between 0 to 100, 100 represents the most vivid degree of color, value of C to some extent represents presentation that the LCD displays signals of high voltage and low voltage.

(II). It is determined that the driving light source intensity of a preset hue is set to be 0 in the preset display area when the second group of the gray scale data is displayed, according to the average hue, the saturation, and the average gray scale.

In a specific embodiment, when the average hue $H_{n,\ m}$ of the preset display area meets the range from 330 to 60 and the color saturation meets the first custom color saturation range from CTL1 to CTH1, if the hue corresponding to the maximum gray scale of the average gray scales is red, the preset hue is red, that is to say, it is determined that the driving light source intensity of the red hue is set to be 0 in the preset display area when the second group of the gray scale data is displayed.

The hue corresponding to the maximum gray scale of the average gray scales is red, including two cases of $Ave_R_{n,\ m}$=A $Ave_G_{n,\ m}$=B>$Ave_B_{n,\ m}$=C and $Ave_R_{n,\ m}$=A>$Ave_B_{n,\ m}$=C>$Ave_G_{n,\ m}$B. In both cases, even if $R_{i,j}$, $G_{i,j}$, $B_{i,j}$ sub-pixel units do not meet the case of $R_{i,j}>G_{i,j}>B_{i,j}$ or $R_{i,j}>B_{ij}>G_{ij}$ for the other pixel units in the preset display area, since $Ave_R_{n,\ m}$=A>$Ave_G_{n,\ m}$=B>$Ave_B_{n,\ m}$=C or $Ave_R_{n,\ m}$=A>$Ave_B_{n,\ m}$=C>$Ave_G_{n,\ m}$=B for the average gray scales in the preset display area and the main display color is red, the sub-pixels covered by R are the majority. The R sub-pixels have already displayed their corresponding luminance signals for the first group of the gray scale data and complementally the drive light source luminance of R hue is adjusted to twice as much. Therefore, the second group of the gray scale data does not display the R sub-pixel compensation signal. Therefore, the driving light source intensity of the red hue of the second group of the gray scale data is set to be 0, for example, the R LED light source signal is adjusted to 0. The minority pixel units in the preset display area do not meets the size order of the average gray scales in the preset display area: $Ave_R_{n,m}$=A>$Ave_G_{n,m}$=B>$Ave_B_{n,m}$=C or $Ave_R_{n,m}$=A>$Ave_B_{n,m}$=C>$Ave_G_{n,m}$=B. As described in case 2, it is possible that the red luminance ratio of the second gray scale data is negative. Therefore, the driving light source intensity of the red hue of the second gray scale data is set to be 0, for example, the R LED light source signal is adjusted to 0, so as to achieve energy conservation without affect the overall picture quality at the same time.

Similarly, it is determined by following manner that when the second group of the gray scale data is displayed, the driving light source intensity of the preset hue in the preset display area is set to be 0, so as to achieve energy conservation without affect the overall picture quality at the same time.

In a specific embodiment, when the average hue $H_{n,m}$ of the preset display area meets the range from 60 to 120 and the color saturation meets the second custom color saturation range from CTL2 to CTH2, if the hue corresponding to the maximum gray scale of the average gray scales is red and the hue corresponding to the second maximum gray scale is green, the preset hue is red, that is to say, it is determined that the driving light source intensity of the red hue is set to be 0 in the preset display area when the second group of the gray scale data is displayed.

In a specific embodiment, when the average hue $H_{n,m}$ of the preset display area meets the range from 60 to 120 and the color saturation meets the second custom color saturation range from CTL2 to CTH2, if the hue corresponding to the maximum gray scale of the average gray scales is green and the hue corresponding to the second maximum gray scale is red, the preset hue is green, that is to say, it is determined that the driving light source intensity of the green hue is set to be 0 in the preset display area when the second group of the gray scale data is displayed.

In a specific embodiment, when the average hue $H_{n,m}$ of the preset display area meets the range from 120 to 210 and the color saturation meets the third custom color saturation range from CTL3 to CTH3, if the hue corresponding to the maximum gray scale of the average gray scales is green, the preset hue is green, that is to say, it is determined that the driving light source intensity of the green hue is set to be 0 in the preset display area when the second group of the gray scale data is displayed.

In a specific embodiment, when the average hue $H_{n,m}$ of the preset display area meets the range from 210 to 240 and the color saturation meets the fourth custom color saturation range from CTL4 to CTH4, if the hue corresponding to the maximum gray scale of the average gray scales is green and the hue corresponding to the second maximum gray scale is blue, the preset hue is green, that is to say, it is determined that the driving light source intensity of the green hue is set to be 0 in the preset display area when the second group of the gray scale data is displayed.

In a specific embodiment, when the average hue $H_{n,m}$ of the preset display area meets the range from 210 to 2400 and the color saturation meets the fourth custom color saturation range from CTL4 to CTH4, if the hue corresponding to the maximum gray scale of the average gray scales is blue and the hue corresponding to the second maximum gray scale is green, the preset hue is blue, that is to say, it is determined that the driving light source intensity of the blue hue is set to be 0 in the preset display area when the second group of the gray scale data is displayed.

In a specific embodiment, when the average hue $H_{n,m}$ of the preset display area meets the range from 240 to 300 and the color saturation meets the fifth custom color saturation range from CTL5 to CTH5, if the hue corresponding to the maximum gray scale of the average gray scales is blue, the preset hue is blue, that is to say, it is determined that the driving light source intensity of the blue hue is set to be 0 in the preset display area when the second group of the gray scale data is displayed.

In a specific embodiment, when the average hue $H_{n,m}$ of the preset display area meets the range from 300 to 330 and the color saturation meets the sixth custom color saturation range from CTL6 to CTH6, if the hue corresponding to the maximum gray scale of the average gray scales is blue and the hue corresponding to the second maximum gray scale is red, the preset hue is blue, that is to say, it is determined that the driving light source intensity of the blue hue is set to be 0 in the preset display area when the second group of the gray scale data is displayed.

In a specific embodiment, when the average hue $H_{n,m}$ of the preset display area meets the range from 300 to 330 and the color saturation meets the sixth custom color saturation range from CTL6 to CTH6, if the hue corresponding to the maximum gray scale of the average gray scales is red and the hue corresponding to the second maximum gray scale is blue, the preset hue is red, that is to say, it is determined that the driving light source intensity of the red hue is set to be 0 in the preset display area when the second group of the gray scale data is displayed.

Referring to FIG. 3, in an embodiment, prior to the step of acquiring the group of the original gray scale data of each of pixel units of the content to be displayed in a preset display area, the method further includes:

S110: a display region of a display is divided into at least two display areas, and the display area is regarded as the preset display area sequentially.

Each of display areas may be sequentially displayed as the preset display area according to a preset order to implement display driving. The preset order can be the order that row ordering is performed firstly and then column ordering is performed, or column ordering is performed firstly and then row ordering is performed. In this way, all the display partitions of the entire display are driven for display, so that the entire display is driven for display.

In an embodiment, the step of dividing the group of the original gray scale data into the first group of the gray scale data and the second group of the gray scale data, according to the group of the original gray scale data of the each of pixel units, the average gray scale of each of the hues, and the original light source intensity; and determining the driving light source intensity of each of the hues in the preset display area includes: if the gray scales of respective hues in the preset display area are the same group of the original gray scale data, the average gray scales of respective hues are the gray scales of respective hues of the group of the original gray scale data. In this case, the group of the original gray scale data is divided into the first group of the gray scale data and the second group of the gray scale data, wherein the gray scale of each of the hues of the first group of the gray scale data is the maximum gray scale in the group of the original gray scale data, and the gray scale of each of the hues of the second group of the gray scale data is 0 or the second maximum gray scale in the group of the original gray scale data; the driving light source intensity of each of the hues is determined in the preset display area according to the original light source intensity, the first group of the gray scale data and the second group of the gray scale data.

A specific example is given below. When the gray scale of each of the hues in the preset display area is a combination of red hues of R=100, G=80 and B=40, the group of the original gray scale data of the original frame corresponding to a pixel unit is divided into the first group of the gray scale data (R1, G1, B1) and the second group of the gray scale data (R2, G2, B2) of the two frames (the first frame and the second frame) corresponding to the pixel unit, wherein the gray scale of each of the hues of the first group of the gray scale data is the maximum gray scale in the group of the original gray scale data, namely 100, that is, R1=100, G1=100, and B1=100. The gray scale of each of the hues of the second group of the gray scale data is 0 or the second maximum gray scale in the group of the original gray scale data, particularly, R2=0, G2=80, and B2=80. The group of the original gray scale data is divided into two groups of the gray scale data, and the two groups of the gray scale data are displayed sequentially in time. That is to say, the original display duration of the original frame signal needs to be divided into two equal time periods. During one time period the first group of the gray scale data is presented; and during the other time period the second group of the gray scale data is presented.

Assuming that the luminance ratios of the front view angle of the group of the original gray scale data ($R_{i,j}$=100, $G_{i,j}$=80, $B_{i,j}$=40) of a pixel unit to the full gray scale 255 are SR %, LG % and MB %, and the luminance ratios of the side view angle are SR'%, LG'% and MB'% correspondingly, where SR>LG>MB, and SR'>LG'>MB'. Since the lower the gray scale signal, the larger the difference between the luminance ratios of the front view angle and the side view angle of the gray scale signal, it can be known that SR/MB>SR'/MB' and LG/MB>LG'/MB'. Such color mixing causes the luminance ratio of the main luminance signal SR to have a larger difference at the front view angle relative to MB. However, the luminance ratio of the main luminance signal SR' has a smaller difference at the side view angle relative to MB'; and toning of the main color at the front view angle is affected and the vivid degree of color is decreased. With optoelectronic properties of the conventional VA display, the standard corresponding relation of the signal to the luminance change meets the formula of exponential power 2.2. For example, $Y=(X/255)^{2.2}$, where Y is the normalized luminance, X is the gray scale (the preferred gray scale is the 8 bit signal of 0 to 255). It can be determined by a look-up table or the manner that the corresponding relation of the signal to the luminance change meets the formula of exponential power 2.2: SR %=13.3%, LG %=7.4%, MB=1.7%, SR'%=39%, LG'%=34.7%, MB'=23.1%.

Since all the gray scales of the first group of the gray scale data are 100, the luminance ratios of the front view angle of respective hues of the first frame can be determined respectively as 13.3%, 12.1% and 12.1%, by a look-up table, and the luminance ratios of the side view angle are respectively as 39%, 41% and 49%. For the second group of the gray scale data ($R2_{i,j}=0$, $G2_{i,j}=80$, $B2_{i,j}=80$), the luminance ratios of the front view angle of respective hues of the second frame can be determined respectively to be 0%, 7.4%, 7.4%; and the luminance ratios of the side view angle are respectively to be 0%, 34.7%, 42.1%.

Since the original frame is changed from one frame to two frames in time sequence, the frame frequency of the display needs to be doubled, and the display time of each frame is ½ of the original display duration. Assuming that the original display duration of the original frame signal is T, it is divided into the sum of the two frame times in time sequence. Since each divided frame time is ½ of the original frame signal, two divided frame driving light source intensity of time sequence must be increased by 1 times, that is, the driving light source intensity of each of the hues of R, G and B has to be increased to double of the original light source intensity, so that the overall luminance can be maintained the same as the signal luminance of the original frame. For R hue, the original light intensity is A_R, and the driving light source intensity should be increased to double of the original light source intensity, that is, the backlight luminance should be A'_R=2*A_R. Further, the luminance ratios of G hue and B hue, TG(G1)+TG(G2)=TG(100)+G(80)=13.3%+7.4%=20.7% is greater than the original brightness ratio of G hue TG(80)=7.4%; and TB(B1)+TB(B2)=TB(100)+TB(80)=12.1%+7.4%=19.5% is greater than the original luminance ratio of B hue TB(40)=1.7%. Therefore, the driving light source intensities of G hue and B hue have to be adjusted complementally, so as to keep the luminance of front view angle of G hue and B hue conservation. Whereby, A'_G=2*A_G*TG(80)/(TG(100)+TG(80))=0.715*A_G; and similarly A'_B=2*A_B*TB(40)/(TB(100)+TB(80))=0.174*A_B.

The comprehensive luminance ratios of frame 1 and frame 2 at the side view angle combined on each of the hues of $R_{ij}$, $G_{ij}$, $B_{ij}$ are (39%+0%)*2=78%, (41%+34.7%)*0.715=54.1%, (49%+42.1%)*0.174=15.9%, while the luminance ratios of each of the hues of $R_{ij}$, $G_{ij}$, $B_{ij}$ of the original frame at side view angle are 39%, 34.7%, 23.1%. Whereby, the luminance ratio value of the main hue R to B is increased from 39%/23.1%=1.696 of the original frame to 78%/15.9%=4.9 of the combined frame. Similarly, the luminance ratio value of the main hue R to G is increased from 39%/34.7%=1.127 of the original frame to 78%/54.1%=1.44 of the combined frame. The combined frame reduces the equivalent luminance of the original frame of a low gray scale and a large view angle, so that the main hue is significantly increased relative to other hues, and the main hue at the side view angle is closer to that at the front view to be presented. It should be noted that the main hue is the hue corresponding to the maximum gray scale in the group of the original gray scale data corresponding to the pixel unit.

Figure 5:
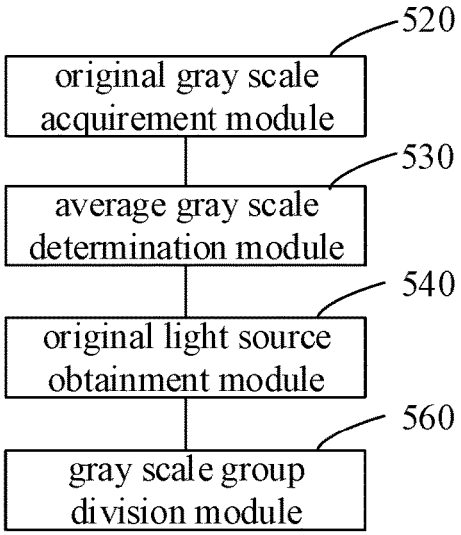
FIG. 5 is a block diagram of a display driving device according to an embodiment.

Referring to FIG. 5, the application further provides a display driving device corresponding to the above method, including:

an original gray scale acquirement module 520 is configured to acquire a group of original gray scale data of each of pixel units of a content to be displayed in a preset display area;

an average gray scale determination module 530 is configured to determine an average gray scale of each of the hues in the preset display area according to the group of the original gray scale data;

an original light source acquirement module 540 is configured to acquire an original light source intensity of each of the hues of the content to be displayed in the preset display area; and a gray scale group division module 560 is configured to decompose the group of the original gray scale data into a first group of gray scale data and a second group of gray scale data, according to the group of the original gray scale data of the each of pixel units, the average gray scale of each of the hues, and the original light source intensity; and determine a driving light source intensity of each of the hues in the preset display area; a gray scale of each of the hues of the first group of the gray scale data is a maximum gray scale in the group of the original gray scale data; and a gray scale of each of the hues of the second group of the gray scale data is equal to 0 or greater than a minimum gray scale in the group of the original gray scale data.

For the above display driving device, the group of the original gray scale data is divided into a first group of gray scale data and a second group of gray scale data, that is to say, an original frame signal corresponding to each of pixel units is combined into a plurality of frames; further, a gray scale of each of the hues of the first group of the gray scale data is a maximum gray scale in the group of the original gray scale data; and a gray scale of each of the hues of the second group of the gray scale data is equal to 0 or greater than a minimum gray scale in the group of the original gray scale data. Whereby, in order to highlight the dominant color and improve the color shift, the gray scale data of each of the hues in the original group of the gray scale data is displayed according to the data greater than the minimum gray scale in the original group of the gray scale data, or not displayed directly; and both groups do not contain the data color of the minimum gray scale in the original group of the gray scale data, thereby reducing the luminance difference between the hue of the low gray scale of the side view angle and the hue of the overall pixel unit, such that the hue of the side view angle appears close to the hue of the front view angle, display of the low color shift is achieved, and the luminance is the same as that of the picture quality of the original picture and is presented.

In an embodiment, the gray scale group division module is further configured to acquire an average hue and saturation of the preset display area; and determine that a driving light source intensity of a preset hue is set to be 0 in the preset display area when the second group of the gray scale data is displayed, according to the average hue and the saturation.

Figure 6:
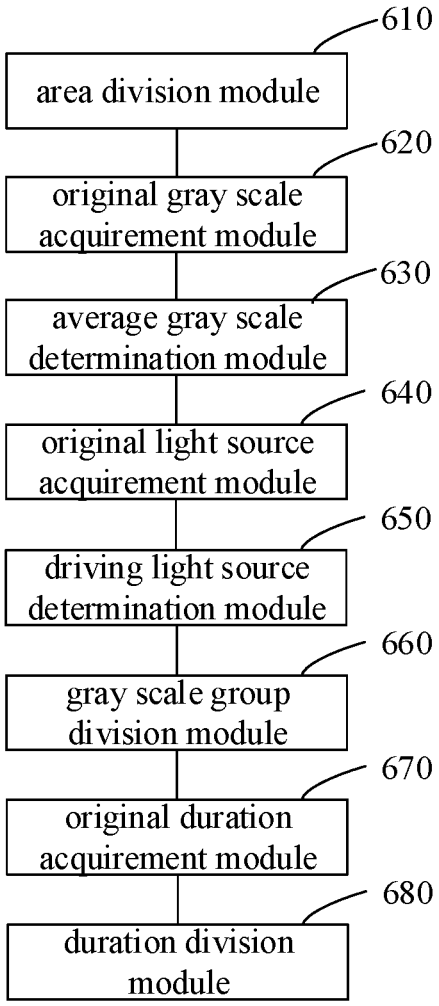
FIG. 6 is a block diagram of a display driving device according to another embodiment.

Referring to FIG. 6, in an embodiment, the display driving device further includes:

an original duration acquirement module 670 is configured to acquire an original display duration of the group of the original gray scale data; and a duration division module 680 is configured to continuously display the first group of the gray scale data and the second group of the gray scale data in the original display duration.

Referring to FIG. 6, in an embodiment, the display driving device further includes a driving light source determination module 650;

the driving light source determination module 650 is configured to determine the driving light source intensity of each of the hues in the preset display area according to the average gray scale of each of the hues;

the gray scale group division module 660 is configured to decompose the group of the original gray scale data into the first group of the gray scale data and the second group of the gray scale data according to the group of the original gray scale data of each of pixel units, the original light source intensity, and the driving light source intensity.

Figure 7:
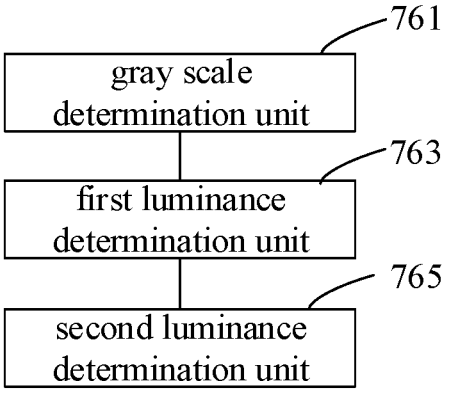
FIG. 7 is a unit block diagram of a module of the display driving device in FIG. 5 or FIG. 6.

Referring to FIG. 7, in an embodiment, the gray scale group division module includes:

a gray scale determination unit 761 is configured to regard a maximum gray scale of each of the hues of the pixel unit as the gray scale of each of the hues of the first group of the gray scale data;

a first luminance determination unit 763 is configured to determine a luminance ratio of the gray scale of each of the hues of the first group of the gray scale data to a full gray scale according to the gray scale of each of the hues of the first group of the gray scale data; and a second luminance determination unit 765 is configured to determine a luminance ratio of the gray scale of each of the hues of the second group of the gray scale data to the full gray scale according to the luminance ratio of the gray scale of each of the hues of the first group of the gray scale data to the full gray scale, the original light source intensity, and the driving light source intensity.

Continuously referring to FIG. 6, in an embodiment, the display driving device further includes:

an area division module 610 is configured to divide a display region of a display into at least two display areas, and sequentially regard the display area as the preset display area.

An embodiment of the application further provides a storage medium corresponding to the above method.

A storage medium stores a computer that, when executed by a processor, implement steps of the above display driving method, wherein the storage medium can be a disk, a CD, a Read-Only Memory (ROM) or Random Access Memory (RAM) and so on.

An embodiment of the application further provides a computer apparatus corresponding to the above method.

A computer apparatus includes a memory, a processor and a computer program stored on the memory and executed on the processor, wherein steps of the above display driving method are implemented when the processor executes the computer program.

Since the above display driving device and the above display driving method correspond to each other, specific technical features in the device corresponding to the above method are not described repeatedly. The above computer apparatus corresponds to the above display driving method, specific technical features in the computer apparatus corresponding to the above method are also not described repeatedly.

The above embodiments merely present several embodiments of the present application, which are described in more detail and particularly, but should not be interpreted as limitation of the scope of the invention. It should be noted that those skilled in the art may make various modifications and improvements without departing from the concept of the present application, all of which fall within the protection scope of the present application. Therefore, the protection scope claimed by the present application shall be subject to the appended claims.

What is claimed is:

1. A display driving method, comprising:

acquiring a group of original gray scale data of each of pixel units of a content to be displayed in a preset display area;

determining an average gray scale of each of hues in the preset display area according to the group of the original gray scale data;

acquiring an original light source intensity of each of the hues of the content to be displayed in the preset display area; and dividing the group of the original gray scale data into a first group of gray scale data and a second group of gray scale data, according to the group of the original gray scale data of the each of pixel units, the average gray scale of each of the hues, and the original light source intensity; and determining a driving light source intensity of each of the hues in the preset display area;

wherein a gray scale of each of the hues of the first group of the gray scale data is a maximum gray scale in the group of the original gray scale data; and a gray scale of each of the hues of the second group of the gray scale data is equal to 0 or greater than a minimum gray scale in the group of the original gray scale data, wherein the step of determining the driving light source intensity of each of the hues in the preset display area comprises:

acquiring an average hue and saturation of the preset display area; and determining that a driving light source intensity of a preset hue is set to be 0 in the preset display area when the second group of the gray scale data is displayed, according to the average hue, the saturation, and the average gray scale.

2. The display driving method of claim 1, wherein after the step of dividing the group of the original gray scale data into the first group of the gray scale data and the second group of the gray scale data, the method further comprises:

acquiring an original display duration of the group of the original gray scale data; and continuously displaying the first group of the gray scale data and the second group of the gray scale data in the original display duration.

3. The display driving method of claim 1, wherein the step of dividing the group of the original gray scale data into the first group of the gray scale data and the second group of the gray scale data, according to the group of the original gray scale data of the each of pixel units, the average gray scale of each of the hues, and the original light source intensity; and determining the driving light source intensity of each of the hues in the preset display area comprises:

determining the driving light source intensity of each of the hues in the preset display area according to the average gray scale of each of the hues; and dividing the group of the original gray scale data into the first group of the gray scale data and the second group of the gray scale data according to the group of the original gray scale data of each of pixel units, the original light source intensity, and the driving light source intensity.

4. The display driving method of claim 3, wherein the step of dividing the group of the original gray scale data into the first group of the gray scale data and the second group of the gray scale data according to the group of the original gray scale data of each of pixel units, the original light source intensity, and the driving light source intensity comprises:

regarding a maximum gray scale of each of the hues of the pixel unit as the gray scale of each of the hues of the first group of the gray scale data;

determining a luminance ratio of the gray scale of each of the hues of the first group of the gray scale data to a full gray scale according to the gray scale of each of the hues of the first group of the gray scale data; and determining a luminance ratio of the gray scale of each of the hues of the second group of the gray scale data to the full gray scale according to the luminance ratio of the gray scale of each of the hues of the first group of the gray scale data to gray scale, the original light source intensity, and the driving light source intensity.

5. The display driving method of claim 1, wherein prior to the step of acquiring the group of the original gray scale data of each of pixel units of the content to be displayed in the preset display area, the method further comprises:

dividing a display region of a display into at least two display areas, and sequentially regarding the display area as the preset display area.

6. The display driving method of claim 3, wherein the step of acquiring the original light source intensity of each of the hues of the content to be displayed in the preset display area comprises acquiring the original light source intensity by a look-up table.

7. The display driving method of claim 4, wherein determining a size of the luminance ratio of the gray scale of each of the hues of the second group of the gray scale data to the full gray scale; when the luminance ratio of the gray scale of each of the hues of the second group of the gray scale data to the full gray scale is less than 0, setting the luminance ratio of the gray scale of each of the hues of the second group of the gray scale data to the full gray scale to be 0; when the luminance ratio of the gray scale of each of the hues of the second group of the gray scale data to the full gray scale is greater than a preset maximum value, setting the luminance ratio of the gray scale of each of the hues of the second group of the gray scale data to the full gray scale as the preset maximum value.

8. The display driving method of claim 5, wherein each of the display areas comprises at least two pixels.

9. The display driving method of claim 1, wherein the display driving method is applied to a liquid crystal display.

10. A display driving device, comprising:

an original gray scale acquirement module configured to acquire a group of original gray scale data of each of pixel units of a content to be displayed in a preset display area;

an average gray scale determination module configured to determine an average gray scale of each of the hues in the preset display area according to the group of the original gray scale data;

an original light source acquirement module configured to acquire an original light source intensity of each of the hues of the content to be displayed in the preset display area; and a gray scale group division module configured to divided the group of the original gray scale data into a first group of gray scale data and a second group of gray scale data, according to the group of the original gray scale data of the each of pixel units, the average gray scale of each of the hues, and the original light source intensity; acquire an average hue and saturation of the preset display area: and determine that a driving light source intensity of a preset hue is set to be 0 in the preset display area when the second group of the gray scale data is displayed, according to the average hue, the saturation, and the average gray scale; a gray scale of each of the hues of the first group of the gray scale data is a maximum gray scale in the group of the original gray scale data;

and a gray scale of each of the hues of the second group of the gray scale data is equal to 0 or greater than a minimum gray scale in the group of the original gray scale data.

11. The display driving device of claim 10, further comprising:

an original duration acquirement module configured to acquire an original display duration of the group of the original gray scale data; and a duration division module configured to continuously display the first group of the gray scale data and the second group of the gray scale data in the original display duration.

12. The display driving device of claim 10, further comprising a driving light source determination module;

the driving light source determination module is configured to determine the driving light source intensity of each of the hues in the preset display area according to the average gray scale of each of the hues;

the gray scale group division module is configured to divide the group of the original gray scale data into the first group of the gray scale data and the second group of the gray scale data according to the group of the original gray scale data of each of pixel units, the original light source intensity, and the driving light source intensity.

13. The display driving device of claim 12, further comprising:

a gray scale determination unit configured to regard a maximum gray scale of each of the hues of the pixel unit as the gray scale of each of the hues of the first group of the gray scale data;

a first luminance determination unit configured to determine a luminance ratio of the gray scale of each of the hues of the first group of the gray scale data to a full gray scale according to the gray scale of each of the hues of the first group of the gray scale data; and a second luminance determination unit configured to determine a luminance ratio of the gray scale of each of the hues of the second group of the gray scale data to the full gray scale according to the luminance ratio of the gray scale of each of the hues of the first group of the gray scale data to the full gray scale, the original light source intensity, and the driving light source intensity.

14. The display driving device of claim 10, further comprising:

an area division module configured to divide a display region of a display into at least two display areas, and sequentially regard the display area as the preset display area.

15. The display driving device of claim 12, wherein the driving light source determination module is further configured to acquire the original light source intensity by a look-up table.

16. The display driving device of claim 13, wherein the second luminance determination unit is further configured to determine size of the luminance ratio of the gray scale of each of the hues of the second group of the gray scale data to the full gray scale; when the luminance ratio of the gray scale of each of the hues of the second group of the gray scale data to the full gray scale is less than 0, set the luminance ratio of the gray scale of each of the hues of the second group of the gray scale data to the full gray scale to be 0; when the luminance ratio of the gray scale of each of the hues of the second group of the gray scale data to the full gray scale is greater than a preset maximum value, set the luminance ratio of the gray scale of each of the hues of the second group of the gray scale data to the full gray scale as the preset maximum value.

17. The display driving device of claim 14, wherein each of the display areas divided by the area division module comprises at least two pixels.

18. A computer apparatus, comprising a memory, a processor and a computer program stored on the memory and executed on the processor, wherein the following steps of a display driving method are implemented when the processor executes the computer program:

acquiring a group of original gray scale data of each of pixel units of a content to be displayed in a preset display area;

determining an average gray scale of each of hues in the preset display area according to the group of the original gray scale data;

acquiring an original light source intensity of each of the hues of the content to be displayed in the preset display area; and dividing the group of the original gray scale data into a first group of gray scale data and a second group of gray scale data, according to the group of the original gray scale data of the each of pixel units, the average gray scale of each of the hues, and the original light source intensity; and determining a driving light source intensity of each of the hues in the preset display area;

wherein a gray scale of each of the hues of the first group of the gray scale data is a maximum gray scale in the group of the original gray scale data; a gray scale of each of the hues of the second group of the gray scale data is equal to 0 or greater than a minimum gray scale in the group of the original gray scale data, wherein the step of determining the driving light source intensity of each of the hues in the preset display area comprises:

acquiring an average hue and saturation of the preset display area, and determining that a driving light source intensity of a preset hue is set to be 0 in the preset display area when the second group of the gray scale data is displayed, according to the average hue, the saturation, and the average gray scale.

* * * * *